US005787613A

United States Patent [19]

Derome

[11] Patent Number: 5,787,613

[45] Date of Patent: Aug. 4, 1998

[54] METHOD AND APPARATUS FOR MELTING SNOW USING EXHAUST AND COOLING SYSTEM WASTE HEAT

[76] Inventor: Andre Derome, 165 est boul. Jacques-Cartier, Longueuil, Quebec, J4L 1C8, Canada

[21] Appl. No.: 675,143

[22] Filed: Jul. 3, 1996

[51] Int. Cl.[6] ..... E01H 5/10

[52] U.S. Cl. ..... 37/228; 37/197; 126/343.5 R

[58] Field of Search ..... 37/227, 228, 229, 37/199, 197; 126/343.5 R

[56] References Cited

U.S. PATENT DOCUMENTS

| | | | |
|---|---|---|---|
| 2,261,732 | 11/1941 | O'Brien | 37/228 X |
| 3,382,603 | 5/1968 | Oberto | 37/227 X |
| 3,404,470 | 10/1968 | Raiti | 37/228 |
| 3,619,918 | 11/1971 | Morin | 37/228 |
| 3,803,732 | 4/1974 | Moreno | 37/228 |
| 4,353,176 | 10/1982 | Hess | 37/228 |
| 4,409,957 | 10/1983 | Muhammad | 37/227 X |
| 4,615,129 | 10/1986 | Jackson | 37/228 X |
| 4,978,068 | 12/1990 | Eldridge | 37/228 X |
| 5,365,681 | 11/1994 | Miranda | 37/227 |
| 5,630,286 | 5/1997 | Vanderlinden | 37/227 |

*Primary Examiner*—Terry Lee Melius
*Assistant Examiner*—Victor Batson
*Attorney, Agent, or Firm*—Eric Fincham

[57] ABSTRACT

An vehicle for removing and melting snow from a roadway wherein the snow is collected, transferred to a snow melting means which utilizes heat from the exhaust and cooling system to melt the snow. The vehicle includes means for restricting flow of a heat transfer fluid such that a greater force is put on the engine which will thereby generate a heat output through the exhaust and radiator cooling system. The vehicle is designed to be operated at relatively high speeds so as not to impede the flow of traffic.

17 Claims, 7 Drawing Sheets

METHOD AND APPARATUS FOR MELTING SNOW USING EXHAUST AND COOLING SYSTEM WASTE HEAT

FIELD OF THE INVENTION

The present invention relates to a method of snow removal and to snow removal machinery and also relates to a snow removal vehicle having the capability of melting the snow.

BACKGROUND OF THE INVENTION

Cities located in climates which receive precipitation in the form of snow are required to spend substantial sums of money on equipment to remove the snow from streets, roads, public access areas, etc. Traditionally, the methods of removing the snow have consisted of the use of a first vehicle to plow the snow to a certain location (such as the side of the road) following which a second vehicle removes the snow. The removal of the snow is usually accomplished by the use of a snow blower loading the snow into trucks which in turn transport the snow to a site where it may be dumped. Often, the sites are rivers or large unoccupied areas.

These traditional methods of snow removal suffer from several disadvantages including the use of multiple vehicles and possible pollution of the site to which the snow is transported. Frequently, the snow removed from the street has small particles mixed therein which have been dumped on the snow to provide traction for vehicles.

In order to overcome these difficulties, it has been proposed in the art that an apparatus could be used to melt the snow while it is being removed. Examples of such proposals are contained in Canadian Patents 907,989, 1,235,605 and 1,202,088. Generally, the prior art shows removal devices which utilize separate heating devices requiring the consumption of a separate fuel.

The prior art proposals which show removal devices having separate heating means have, in common with conventional equipment, the disadvantage of impeding the flow of traffic. Thus, these pieces of equipment are usually built and operate at relatively low speeds. As a result, they must be operated in non-peak traffic times or the traffic flow is slowed down substantially.

SUMMARY OF THE INVENTION

It is an object of the present invention to provide a vehicle for collecting and melting snow, the vehicle being compact and efficient.

It is a further object of the present invention to provide a vehicle for collecting and melting snow, the vehicle utilizing heat generated by the engine or motor of the vehicle for purposes of melting the snow.

It is a still further object of the present invention to provide a method for removing snow from a roadway and which method utilizes a single vehicle.

It is a further object of the present invention to provide a method for removing snow from the roadway wherein the snow may be disposed of in an efficient and non polluting manner.

It is a further object of the present invention to provide a method and vehicle for removing snow from the roadway wherein the vehicle may be operated at a relatively high speed to minimize disruption to traffic.

According to one aspect of the present invention, there is provided an improvement in a snow removal vehicle which utilizes an internal combustion engine and has snow melting means and snow collecting means. Snow conveying means are adapted to convey snow from the collecting means to the melting means. The vehicle utilizes means to transfer heat generated by operation of the internal combustion engine to the snow melting means.

In a further aspect of the present invention, there is provided a snow removal vehicle which includes an internal combustion engine having a cooling system and an exhaust system. The vehicle has snow melting means, snow collecting and snow conveying means which are designed to collect snow and convey the snow to the snow melting means. The snow melting means have a receptacle for receiving the snow from the snow conveying means. There is also provided a heat exchange system which includes a heat transfer fluid and a first heat exchanger means to transfer heat from the heat transfer fluid to the snow melting means. A second heat exchanger is adapted to transfer heat from liquid associated with the cooling system of the internal combustion engine to the heat transfer fluid. A third heat exchanger is adapted to transfer heat from the exhaust gases emitted by the internal combustion engine to the heat transfer fluid.

In a further aspect of the present invention, there is provided a method of removing and treating snow from a roadway comprising the steps of supplying a vehicle having engine means with an exhaust and a radiator cooling system, means for collecting snow from the roadway, snow melting means, and means for transferring the snow from the snow collecting means to the snow melting means, passing exhaust from the exhaust means and liquid from the radiator cooling system through a conduit, and distributing snow against the conduits to thereby melt the snow.

In a still further aspect of the invention, there is provided a vehicle for removing and melting snow from a roadway, the vehicle comprising engine means having an exhaust and a radiator cooling system, means for collecting snow from the roadway, snow melting means, means for transferring the snow from the snow collecting means to the snow melting means, the snow melting means including heat exchange means for transferring heat from the exhaust and from the cooling system to a heat transfer fluid, and means for pumping the heat transfer fluid through conduit means, the conduit means being located to be in contact with the snow, and means for collecting the liquid resulting from the snow being in contact with the heated conduits.

In a still further aspect of the invention, there is provided a method of snow removal, the method comprising the step of supplying a vehicle having snow collecting means, snow conveying means and snow melting means, moving said vehicle at a relatively high speed to continually collect the snow, transferring the snow on a continuous basis to the snow melting means, melting the snow, separating aggregate from the melted snow, and redistributing the aggregate on the roadway.

In greater detail, the vehicle of the present invention is preferably of the self-propelled type having a chassis or frame with wheels being driven by a motor or engine (a suitable internal combustion engine). It will be understood that within the term "vehicle", many different arrangements are possible including ones wherein cabs and trailers are interconnected. The present invention contemplates recovery of heat generated by the vehicle internal combustion engine and which heat is normally wasted. There are different potential sources of heat—the heated gases emanating from the exhaust, the heat which normally is absorbed by the cooling system for the engine and then dissipated, and heat generated by the motor or engine itself.

The apparatus will include means for transferring the snow from a place where it is collected to the heater means. To this end, various different mechanisms may be employed ranging from different types of scoops to a continuous conveyor. Preferably, the continuous conveyor is utilized such that the apparatus can run on a continual basis.

In the practice of the present invention, it will be understood that the term "snow" includes the snow deposited on roadways, parking lots, etc. The use of the present invention is described with respect to a roadway since this is the place where it would receive widest use; it could also be used wherever it is desired to move snow and melt the same i.e. roads, parking lots, driveways, etc.

Having thus generally described the invention, reference will be made to the accompanying drawings illustrating an embodiment thereof, in which:

DESCRIPTION OF THE PREFERRED EMBODIMENTS

Figure 1:
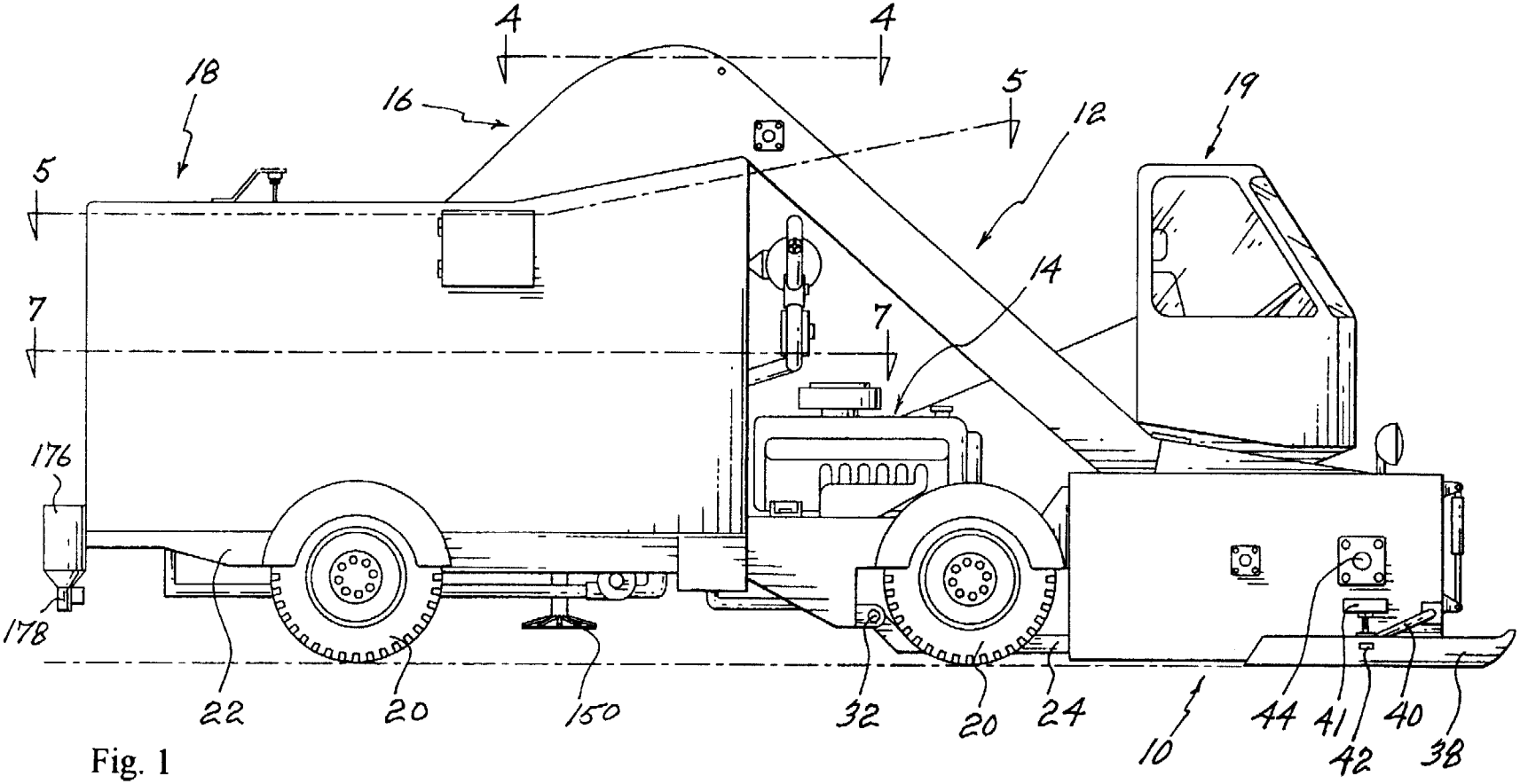
FIG. 1 is a side elevational view of a vehicle according to the present invention.
Figure 1A:
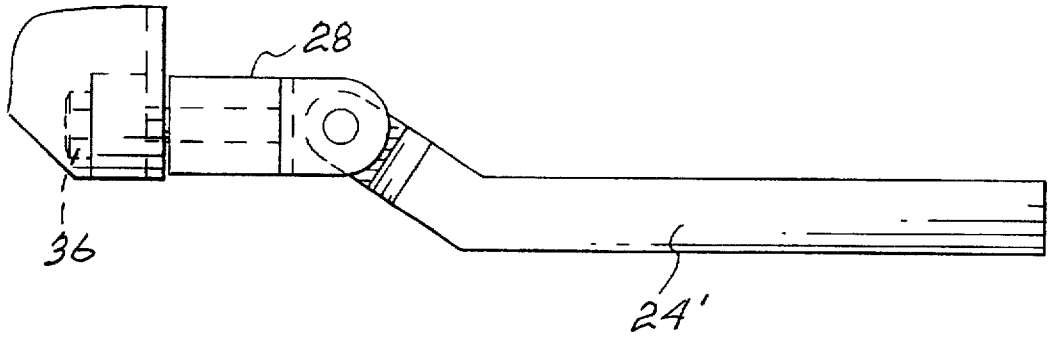
FIG. 1A is a side elevational view of a portion of the mounting arrangement for the ski module.

Referring to the drawings in greater detail and by reference characters thereto, the vehicle of the present invention may conveniently, for purposes of explanation, be divided into several different modules. Thus as shown in FIG. 1 there is provided a snow collecting module generally designated by reference numeral 10; a snow transfer module 12, an engine module 14; a snow treatment module generally designated by reference numeral 16; a storage module 18 and a driver control module 19.

The vehicle will include conventional means associated with vehicles and which will not be described in great detail herein. It suffices to say that the vehicle, will include suitable frame members which are generally designated by reference numeral 22 and which vehicle is adapted to be propelled through wheels 20. Driver control module 19 will include all the conventional controls for the vehicle and for operating the mechanisms of the present invention.

Figure 1B:
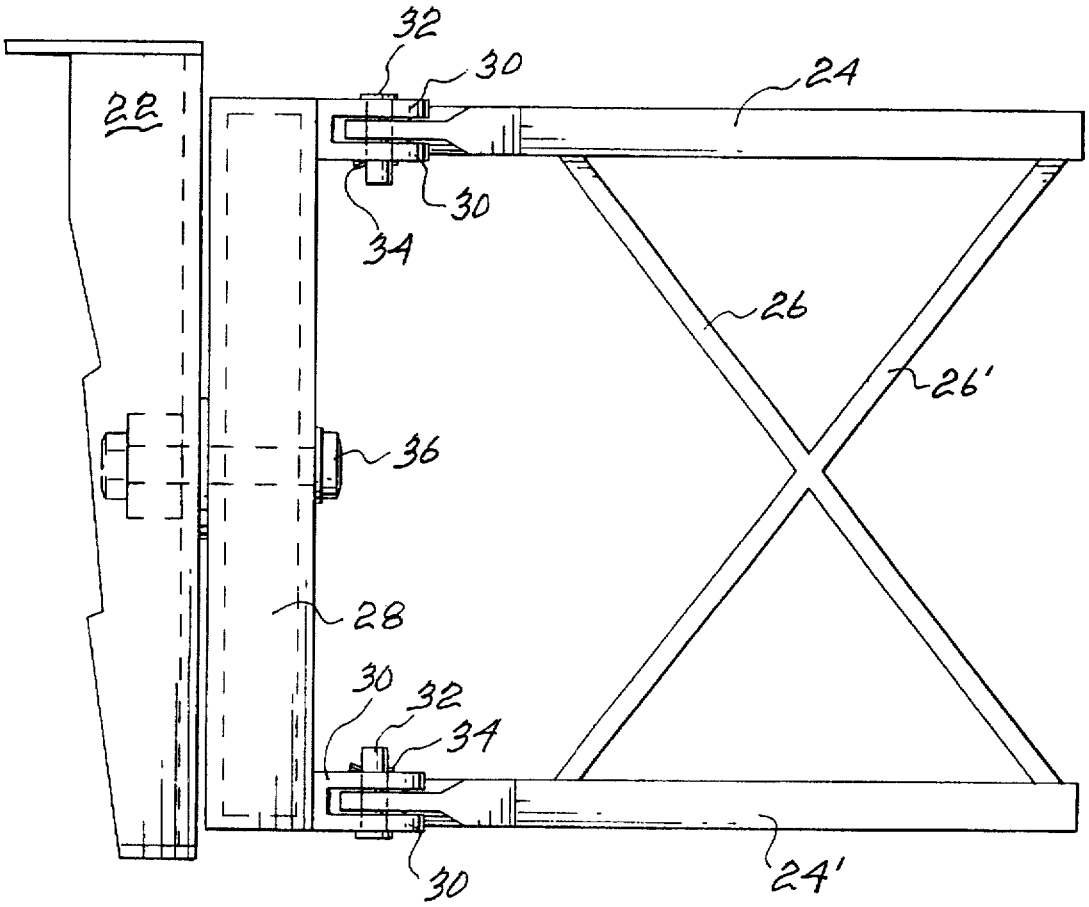
FIG. 1B is a top plan view of FIG. 1A.
Figure 2:
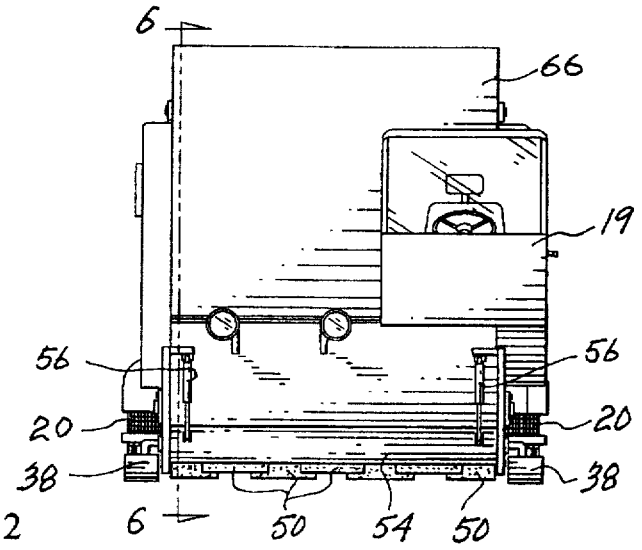
FIG. 2 is a front elevational view of the vehicle.
Figure 3:
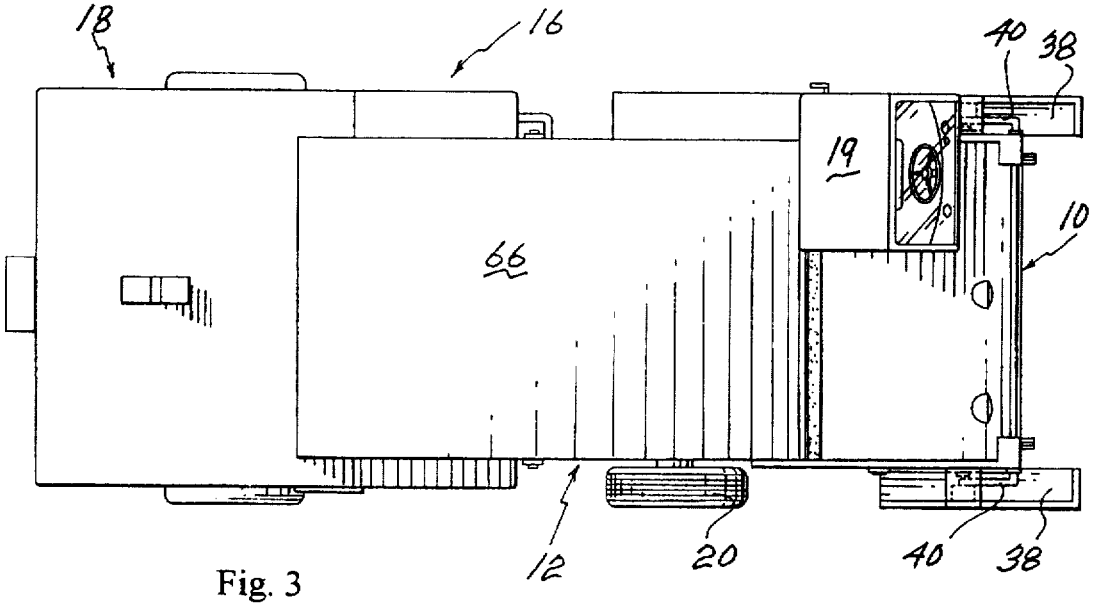
FIG. 3 is a top plan view thereof.
Figure 4:
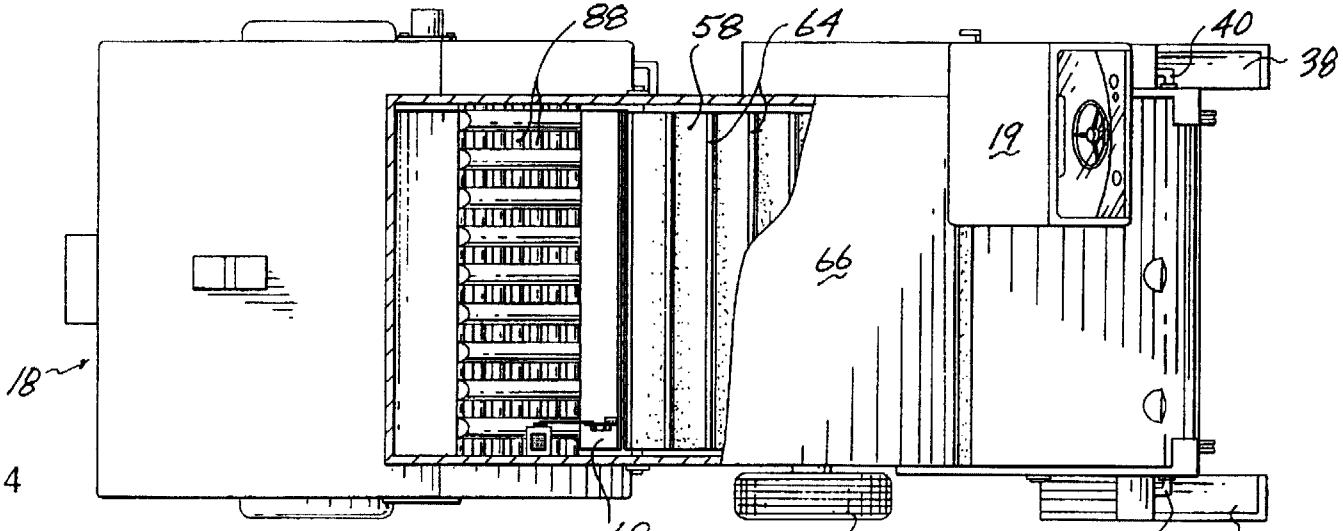
FIG. 4 is a sectional view taken along the lines 4—4 of FIG. 1.

The snow collecting module 10 is a floating assembly and to this end, there are provided a pair of side members 24 and 24' which are interconnected by cross members 26 and 26' (see FIG. 1B). An end member 28 includes pairs of flanges 30 adapted to receive and mount side members 24 and 24' by means of pins 32 and cotter pins 34. In turn, end member 28 is mounted to frame 22 by means of a nut and bolt arrangement 36 which allows end member 28 to pivot. Similarly, each of side members 24 and 24' can pivot by means of their mounting of pin 32. Cylinder 25 (FIG. 6) can be used to adjust the height.

Skis 38 are provided at the front of snow collecting module 10 and are mounted by means of arms 40. It will be noted that ski 38 is mounted at a mid pivot point 42 to allow pivoting of the ski. Thus, when the vehicle is in motion, the pivotable movement of the skis and each of the side members 24, 24' along with end member 28 provides for flexibility that will minimize damage to the snow collecting module when hitting bumps and the like. A ski height adjustment 41 is also provided.

Figure 6:
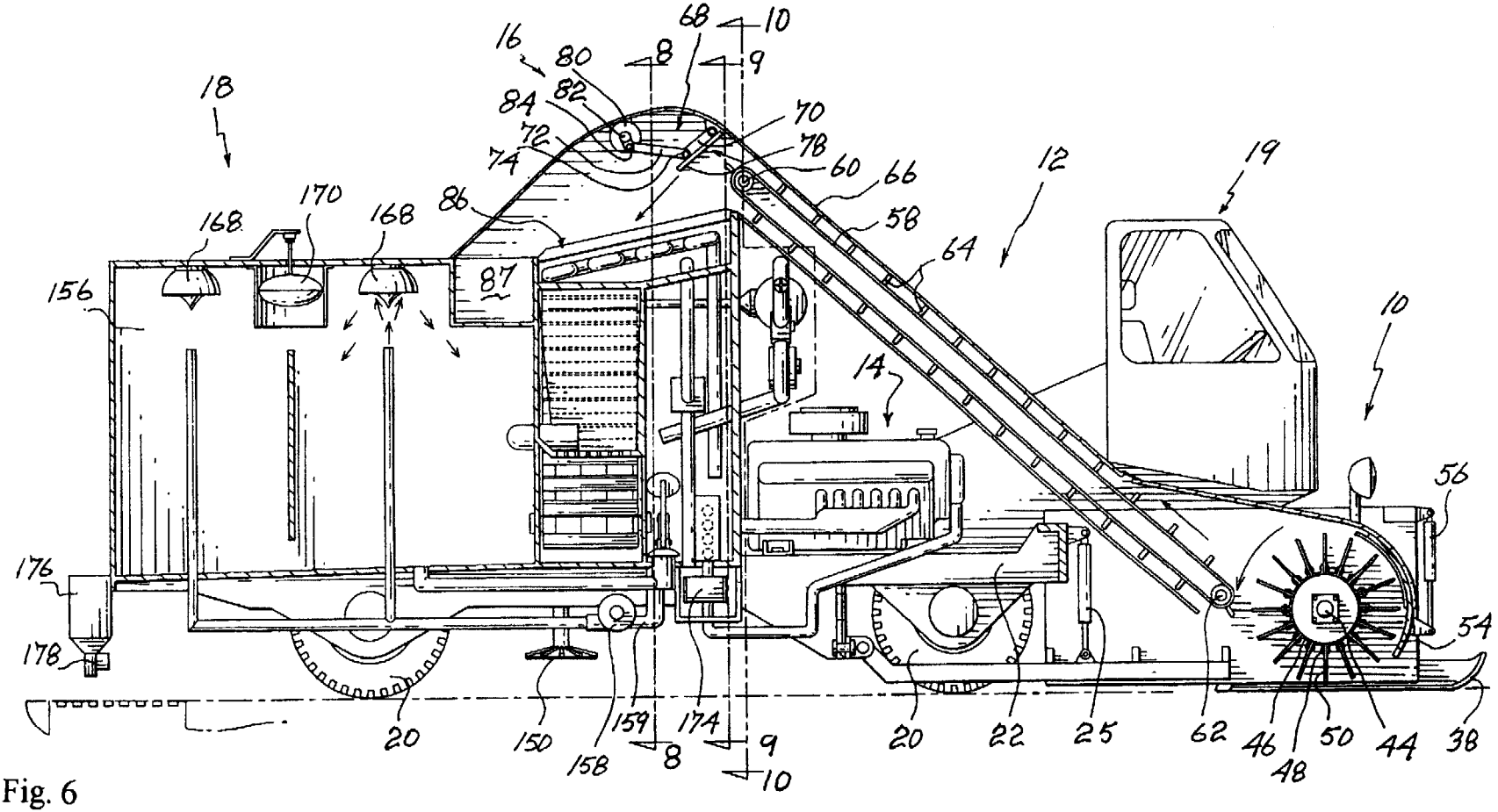
FIG. 6 is a side sectional view taken along the lines 6—6 of FIG. 2.
Figure 7:
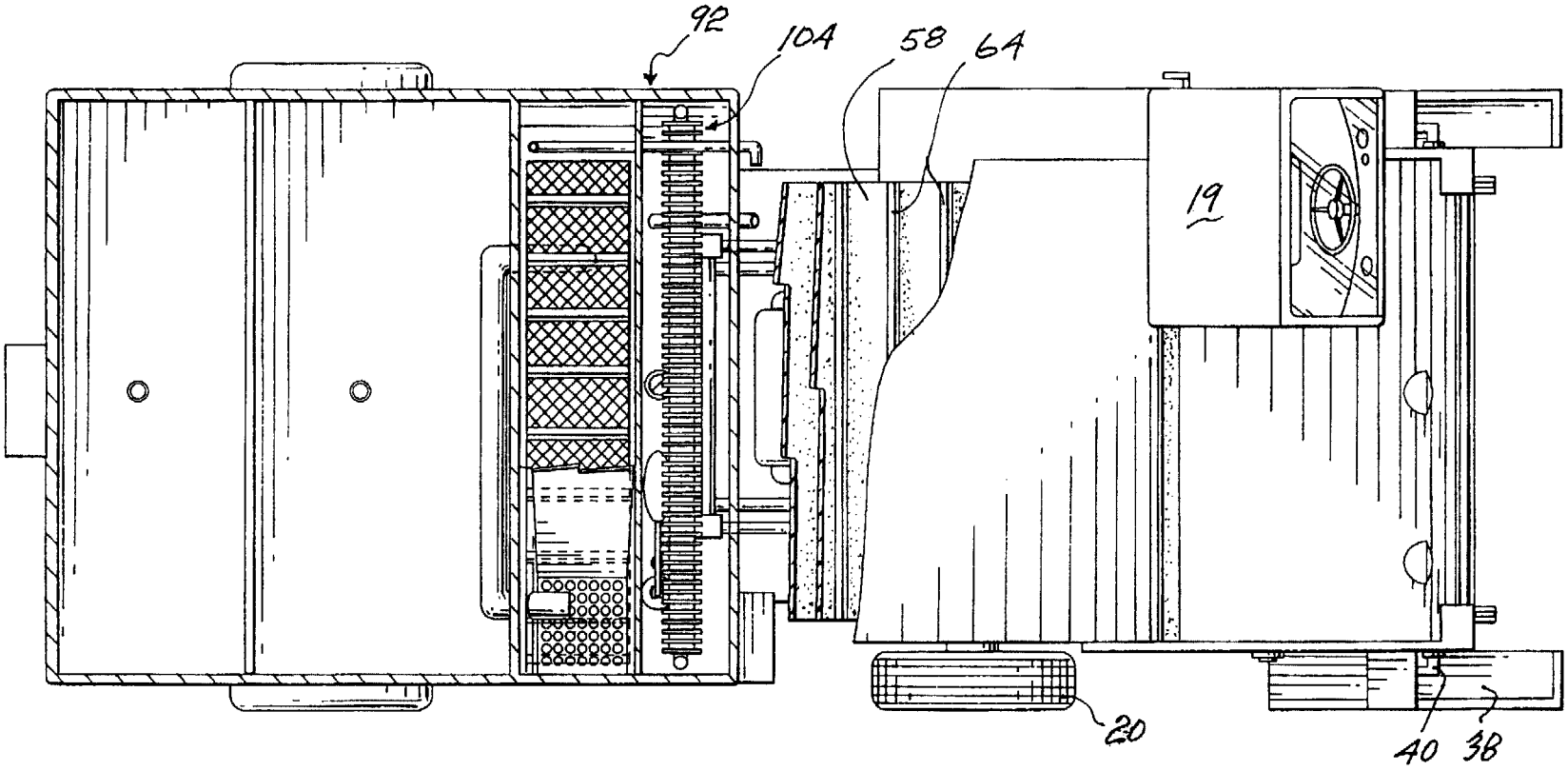
FIG. 7 is a sectional view taken along the lines 7—7 of FIG. 1.

As seen in FIG. 6, snow collecting module 10 includes a rotatably driven shaft 44 (driven by suitable means, not shown) about which extends a cylindrically shaped member 46. Mounted on member 46 are pairs of L-shaped elements 48 which serve to mount flexible blade segments 50. Blade segments 50 are adapted to pick up the snow from the roadway through rotation of shaft 44 in a direction counter to the direction of movement of the vehicle.

To control entry and access to flexible blades 50, a moveable door 54 can be adjusted by means of cylinders 56. This capability can act as a safety feature to limit the entry height.

Snow transfer module 12 includes a conveyor generally designated by reference numeral 58 and which extends about shafts 60 and 62, at least one of which is rotatably driven by suitable means (not shown). A plurality of transversely extending vanes 64 extend across conveyor 58 such that snow received from blades 50 will be discharged thereon and carried upwardly. A suitable housing 66 surrounds conveyor 58; housing 66 is designed to substantially seal conveyor 58 for reasons discussed hereinbelow.

Located proximate the upper end of conveyor 58 and on the interior surface of housing 66 is a snow deflecting device generally designated by reference numeral 68. Snow deflecting device 68 includes a pair of arms 70 and 72, arms 70 having a deflecting member 78 mounted thereon. Arm 70 is pivotably connected to arm 72 at point 74 and is also pivotably connected to the interior of housing 66. Arm 72 is connected eccentrically to disk 80 at pivot point 84. Disk 80 is mounted on a shaft 82 which is rotatably driven by suitable means (not shown).

Snow deflecting device 68 is adapted to receive snow from the conveyor 58 and distribute the snow over a wider area due to the constantly changing angle of deflecting member 78 with respect to the snow discharged from conveyor 58.

The vehicle will include a suitable engine module 14 which is not described in detail herein. It suffices to say that engine module 14 may be any suitable internal combustion engine including diesel engines, gasoline driven engines, etc. The engine will preferably provide power to operate the vehicle and the accessories including those described herein.

Figure 5:
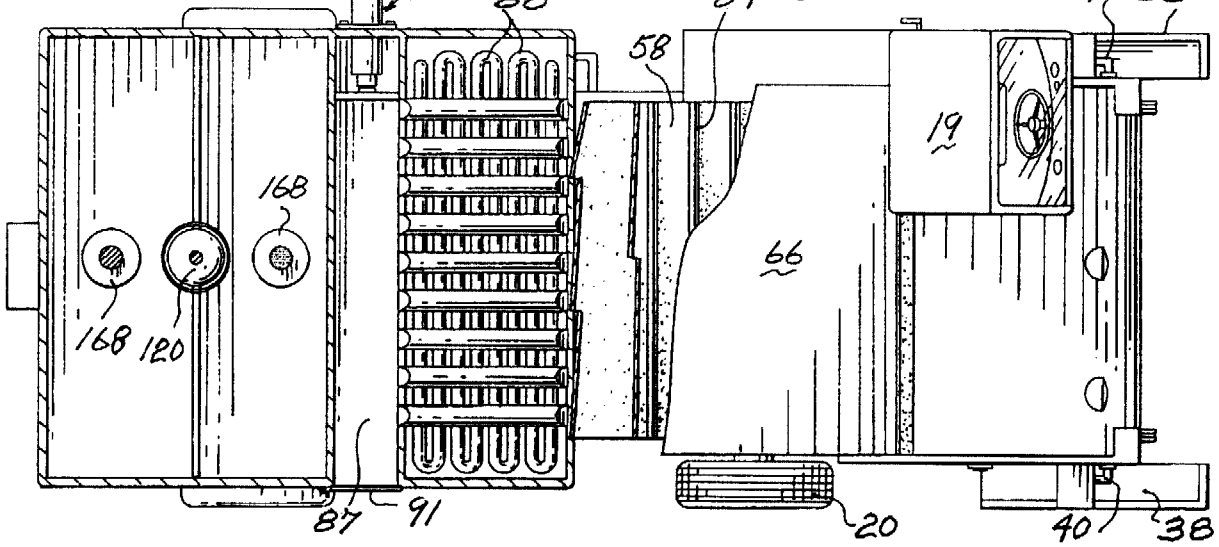
FIG. 5 is a sectional view taken along the lines 5—5 of FIG. 1.

Snow treatment module 16 includes an upper inclined surface 86 having apertures therein. The apertures are sized to permit the passage of snow and small aggregate material while large chunks of ice and debris (such as mufflers, wheels covers, etc.) will be discharged from the inclined surface to a debris compartment 87. Debris compartment 87, as shown in FIG. 5, may have a ram arrangement consisting of a cylinder 89 such that debris can be pushed through a door 91 when is it desired to unload the same.

As may be seen, snow treatment module 16 also includes a plurality of conduits 88 for melting the snow and an aggregate conveyor 90 situated therebelow. A thermal system generally designated by reference numeral 92 is also included in the snow treatment module 16 and will now be referred to.

Figures 8, 9, 10:
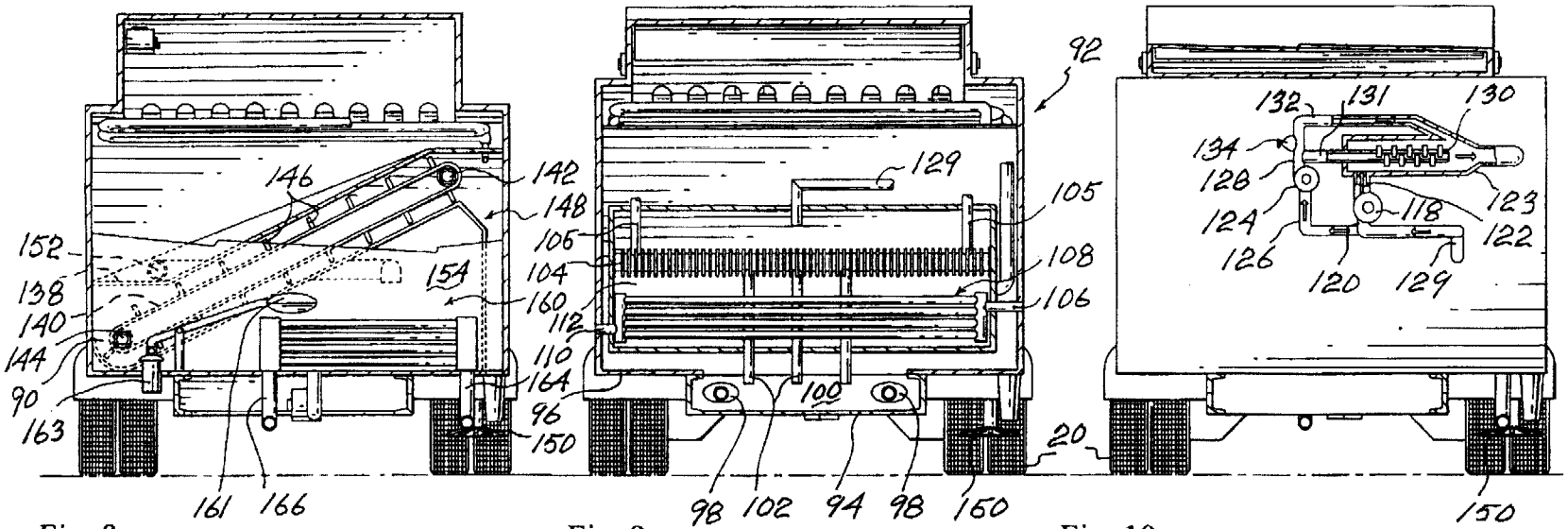
FIG. 8 is a sectional view taken along the lines 8—8 of FIG. 6.
FIG. 9 is a sectional view taken along the lines 9—9 of FIG. 6.
FIG. 10 is a sectional view taken along the lines 10—10 of FIG. 6.

Thermal system 92 is schematically illustrated in FIG. 9 and will now be described in greater detail. Thermal system 92 includes an outer reservoir 94 and an inner reservoir 96. Situated in the bottom of outer reservoir 94 are catalytic converters 98 and arranged such that all the exhaust from the engine is discharged in an exhaust chamber 100 which is filled with volcanic rock to retain heat and which chamber 100 is formed between outer reservoir 94 and inner reservoir 96.

From exhaust chamber 100, the exhaust may exit through ducts 102 to a heat exchanger 104 for reasons which will become apparent hereinbelow. Finally, the exhaust will exit, after giving up its heat in heat exchanger 104, through exhaust pipes 105. Exhaust pipes 105 emit the exhaust such that it will travel past conduits 88 through upper surface 86 into the area covered by closure 66. Subsequently, exhaust will pass within enclosure 66 through to snow collecting module 10. If unable to follow this course due to snow blocking the passageway, the exhaust may exit through debris compartment 87 and then into the area covered by closure 66.

Thermal system 92 also includes means for recovering heat from the cooling system associated with the engine. To this end, there is provided an inlet 106 from the water pump to receive the cooling liquid from the engine to a radiator generally designated by reference numeral 108. Radiator 108 again functions as a heat exchange mechanism to give up its heat as will be described hereinbelow. The radiator has a cooling fluid outlet 110.

The interior of inner reservoir 96 functions as a heat exchange fluid chamber 112 which is filled with a suitable heat exchange fluid and which is adapted to recover heat from heat exchanger 104 (the exhaust) and also from radiator 108.

Thermal system 92 includes a fluid pumping arrangement comprising a first pump 118 having an inlet 120 and an outlet 122. Pump 118 is of the type adapted to work at a low pressure and a high volume. A second pump 124 also has an inlet 126 and an outlet 128. Pump 124 is of the type adapted to work at a high pressure and relatively low volume.

The heat exchange fluid is adapted to enter a conduit 129 in operative fluid connection with inlets 120 and 126 of pumps 118 and 124 respectively. Outlet 122 of pump 118 is adapted to feed the heat exchange fluid to conduits 88 by means of conduit 123 while outlet 128 of pump 124 may feed an inlet 131 to hydraulic lock 130 (within conduit 123) or a bypass 132. The amount entering either by pass 132 or hydraulic lock 130 is controlled by means of a suitable valve 134. The heat exchange fluid is then fed to conduits 88 for melting of the snow.

The above arrangement permits one to increase the heat emanating from the catalytic converter 98 by increasing the pressure inside high pressure pump 124 with valve 134 being closed to force the fluid to pass through hydraulic lock 130. Thus, when valve 134 is closed or partially closed, the liquid must pass through hydraulic lock 130 which increases its pressure and heat while putting an additional force on the engine which will then increase the temperature of its exhaust gases and of its cooling systems.

An aggregate conveyor section 90 (FIG. 8) is situated at the rear of the thermal system 92 and is adapted to receive the water (melted snow) and small particles via a funnel 138. As may be best seen in FIG. 8, this section includes a conveyor 140 journalled about shafts 142 and 144. Conveyor 140 includes a plurality of transversely extending vanes 146. Conveyor 140 preferably has a plurality of apertures therein such that water carried by the conveyor is allowed to seep therethrough. Small particles will become entrained by the transversely extending vanes 146.

At the upper end of conveyor 140 there is provided a chute 148 into which the aggregate material is discharged. From there, it falls to a conventional spreader 150 for redistribution on the road surface.

Mounted within the section at the base of conveyor section 90 is an outlet duct 152 which is adapted to transfer the water to a first storage section 154. There is also provided at the rear of the vehicle a second storage section 156 (FIG. 6). At the bottom of section 154 there is provided a float device 161 operating in conjunction with a plug 163 in the bottom wall. Thus, as may be seen, when there is sufficient water in section 154, plug 163 seals the opening. However, should the water fall below a desired level (such as no snow is being melted) operation of float 161 ensures that there is sufficient water for purposes of cooling radiator 160. The apparatus is designed to always have a certain minimum volume of liquid available.

Associated with section 154, there is provided a high volume water pump 158 (FIG. 6).

Also mounted in section 154 is a second radiator 160 having an inlet 164 which is normally connected to outlet 110 associated with radiator 108. When the apparatus reaches operating temperature, radiator 108 is bypassed and only radiator 160 is functional. Radiator 160 includes an outlet 166. This second radiator ensures proper engine cooling when sufficient heat is not removed by radiator 108. Thus, when the vehicle is not moving or going forward without melting any snow, the engine coolant may become too hot and the water within section 154 will ensure proper cooling. Also, radiator 160 ensures that the water in reservoir 156 remains above the freezing point. Radiator 160 may be bypassed during start-up until the apparatus reaches operating temperature.

Pump 158 is adapted to pump the newly melted water from section 154 against deviators 168 mounted in storage section 156. This pumping helps ensure that the water in this section does not freeze.

Section 156 includes an upper float 170 adapted to give out a signal to the operator when the reservoir is nearing its capacity.

Float 170 may also be used to initiate a water treatment by injecting neutralizing products from a storage compartment 174 into inlet 159 of pump 158 when section 156 is full and needs to be emptied.

Following the water treatment, the water may be discharged through a conduit 176 having an operator controlled valve 178 associated therewith.

The above arrangement provides a vehicle which can remove the snow, melt the same and discharge a neutralized product to the sewers or other location. It requires only the heat from the engine for operation and can be controlled by a single person from the cabin.

It will be understood that the above described embodiment is for purposes of illustration only and that changes and modifications may be made thereto without department from the spirit and scope of the invention.

I claim:

1. A vehicle for removing and melting snow from a roadway, the vehicle comprising engine means having an exhaust and a radiator cooling system, means for collecting snow from said roadway, snow melting means, means for transferring said snow from said snow collecting means to said snow melting means, said snow melting means including heat exchange means for transferring heat from said exhaust and from said cooling system to a heat transfer fluid, and means for pumping said heat transfer fluid through conduit means, said conduit means being located to be in contact with said snow, and means for collecting the liquid resulting from said snow being in contact with said heated conduits.

2. The vehicle of claim 1 wherein said vehicle includes means for putting an additional force on said engine means such that said engine means will generate a greater heat output through said exhaust and said radiator cooling system, said means for putting an additional force on said engine means being independent of the vehicle speed.

3. The vehicle of claim 1 wherein said snow collecting means is mounted on a floating support mechanism.

4. The vehicle of claim 1 wherein said snow collecting means includes a plurality of flexible members adapted to be rotatably driven in a direction counter to the direction of the vehicle.

5. The vehicle of claim 1 further including first and second pump means associated with said heat transfer fluid for pumping said heat transfer fluid through said conduit means, said first pump means being a high volume low pressure pump means and said second pump means being a low pressure high volume pump means.

6. The vehicle of claim 5 wherein said means for putting an additional force on said engine means comprises means for restricting the flow of said heat transfer fluid.

7. The vehicle of claim 1 further including means for treating said liquid prior to discharge thereof.

8. The vehicle of claim 1 further including means for separating foreign objects and large ice pieces from said snow.

9. The vehicle of claim 1 further including means for separating small aggregate material collected with said snow from said liquid; said small aggregate material being of a size suitable for use on a roadway.

10. The vehicle of claim 9 further including means for spreading said small aggregate material on said roadway.

11. The vehicle of claim 1 further including means for distributing said snow on said snow melting means.

12. The vehicle of claim 4 further including means for limiting access to said snow collecting means.

13. The vehicle of claim 1 further including storage means for said liquid, said storage means having pump means associated therewith to provide for continuous liquid movement therein.

14. A method of removing and treating snow from a roadway comprising the steps of supplying a vehicle having engine means with an exhaust means and a radiator cooling system, means for collecting snow from said roadway, snow melting means, and means for transferring said snow from said snow collecting means to said snow melting means, passing exhaust from said exhaust means and liquid from said radiator cooling system through a conduit, adding neutralizing material to said melted snow and then discharging said melted snow and distributing snow against said conduit to thereby melt said snow.

15. The method of claim 14 further including the step of recovering small aggregate material after said snow has been melted and reusing said aggregate material.

16. The method of claim 14 further including the step of separating large solid objects from said snow prior to melting said snow.

17. The method of claim 14 further including the step of putting an additional force on said engine means to generate a greater heat output from said exhaust means and said radiator cooling system.

* * * * *